United States Patent [19]

Kasai

[11] Patent Number: 5,033,171

[45] Date of Patent: Jul. 23, 1991

[54] BUCKLE FOR CONNECTING TWO STRAPS OR THE LIKE

[75] Inventor: Kazumi Kasai, Namerikawa, Japan

[73] Assignee: Yoshida Kogyo K.K., Tokyo, Japan

[21] Appl. No.: 502,734

[22] Filed: Apr. 2, 1990

[30] Foreign Application Priority Data

Mar. 31, 1989 [JP] Japan ..... 1-38587

[51] Int. Cl.[5] ..... A44B 11/25

[52] U.S. Cl. ..... 24/614; 24/648; 24/196

[58] Field of Search ..... 24/648, 634, 635, 643, 24/614, 625, 196, 171

[56] References Cited

U.S. PATENT DOCUMENTS

| | | | |
|---|---|---|---|
| 2,061,463 | 11/1936 | Hall | 24/625 X |
| 3,163,905 | 1/1965 | Gaylord | 24/196 |
| 4,570,310 | 2/1986 | Gelula | 24/648 X |

FOREIGN PATENT DOCUMENTS

| | | | |
|---|---|---|---|
| 320755 | 4/1902 | France | 24/196 |
| 1350887 | 12/1963 | France | 24/635 |
| 51-1934 | 1/1976 | Japan . | |
| 58-196610 | 12/1983 | Japan . | |
| 112098 | 4/1989 | Japan . | |
| 1582516 | 1/1981 | United Kingdom . | |

*Primary Examiner*—James R. Brittain

*Attorney, Agent, or Firm*—Hill, Van Santen, Steadman & Simpson

[57] ABSTRACT

A buckle (10) comprises a plug (11) and a socket (12) releasably engageable with the plug (11). The socket (12) includes a socket body (21) having an opening (28) formed in its front end, and a pair of catch plates (22, 22) pivotally mounted at their respective middles on the opposite sides of the socket body (21) and each having at its front end an engaging prong (37, 37) and its rear end an abutment (38, 38). The plug (11) includes a plug proper (14) having a shank (14'), a plug head (16) formed contiguously to the front end of the shank (14') and having on its opposed sides a pair of engaging shoulders (17, 17) and means (**19*a*, 19*b*) provided on the front end of the plug head (16) for, when the plug proper (14) is fully forced into the socket body (21), urging the abutments (38, 38) outwardly apart from each other so that the catch plates (22, 22) rotate in the direction to bring their engaging prongs (37, 37) into catching engagement with the engaging shoulders (17, 17) of the plug proper (14**).

14 Claims, 6 Drawing Sheets

BUCKLE FOR CONNECTING TWO STRAPS OR THE LIKE

BACKGROUND OF THE INVENTION

1. Title of the Invention

The present invention relates to a buckle comprising a plug attached to one end of a belt and a socket attached to the other end of the belt, the plug and the socket being releasably engageable with each other to join both ends of the belt together.

2. Description of the Prior Art

A typical buckle of the type described is disclosed in Japanese Utility Model Publication No. 51-1934. The disclosed buckle comprises a plug and a socket releasably engageable with the plug. The plug includes a rectangular frame-like belt attaching portion and an arrow-like plug proper integrally extending therefrom and having engaging shoulders on its opposed sides. The socket includes a box-like socket body having an opening in the front end for receiving the plug therethrough; a pair of catch plates rotatably mounted at their middles on the opposed sides of the socket body and having at their respective front ends engaging prongs; and a wire spring normally urging the rear ends of the catch plates in the direction that the catch plates rotate so as to move their respective prongs towards each other. The catch plates have on their respective outer sides grip portions which are exposed through the cutouts formed in the opposed sides of the socket for permitting the wearer to operate the catch plates.

For coupling together the plug and the socket, the plug is forced through the opening into the socket and wedge the catch plates against the bias of the tortion coil spring until the engaging shoulders of the plug comes into snapping engagement with the prongs of the catch plates. For uncoupling the plug and the socket, compressing the grip plates of the catch plates against the bias of the spring would cause the engaging prongs to come out of engagement with the engaging shoulders of the plug.

However, the conventional buckle of this type has suffered from drawbacks in that the socket includes at least as many parts as four; that is, a socket body, a pair of catch plates and a coil tortion spring. The more is the number of the parts, the more expensive is the buckle as a whole and the more is the number of steps of assemblage.

SUMMARY OF THE INVENTION

With the foregoing difficulties in view, it is therefore an object of the present invention to provide a buckle wherein the number of parts are reduced to minimum so that the buckle as a whole is less expensive and easy to assemble.

According to the present invention, there is provided a buckle comprising a plug and a socket releasably engageable with the plug: the socket including a socket body being of a box-like construction and having an opening formed in its front end, and a pair of catch plates pivotally mounted at their respective middles on the opposite sides of the socket body and each having at its front end an engaging prong and at its rear end an abutment; the plug including a plug proper having a shank, a plug head formed contiguously to the front end of the shank and having on its opposed sides a pair of engaging shoulders and means provided on the front end of the plug head for, when the plug proper is inserted into the socket body, urging the abutments outwardly apart from each other.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
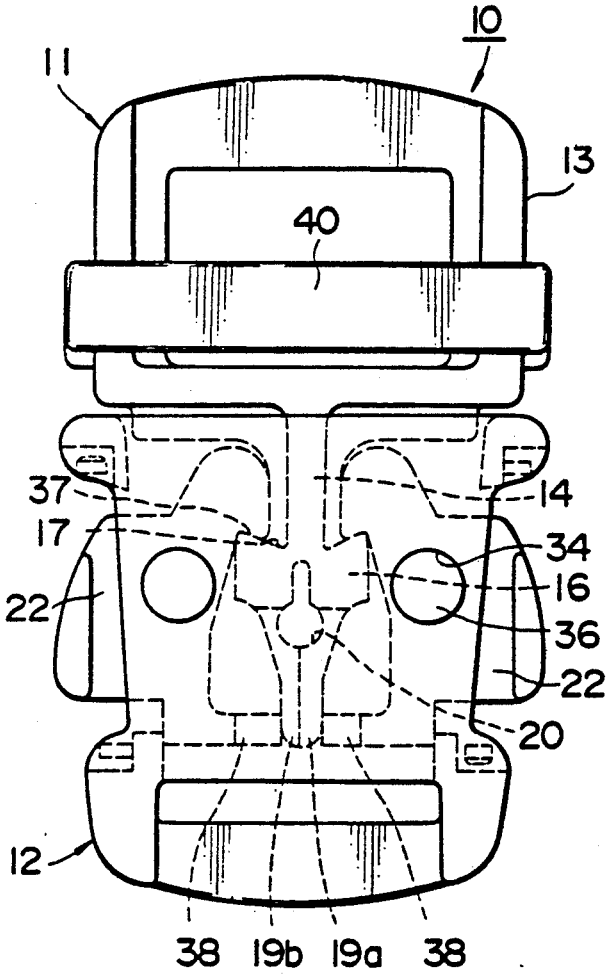
FIG. 1 is a front elevational view of a buckle according to the present invention and shows a plug and a socket fully coupled together.
Figure 2:
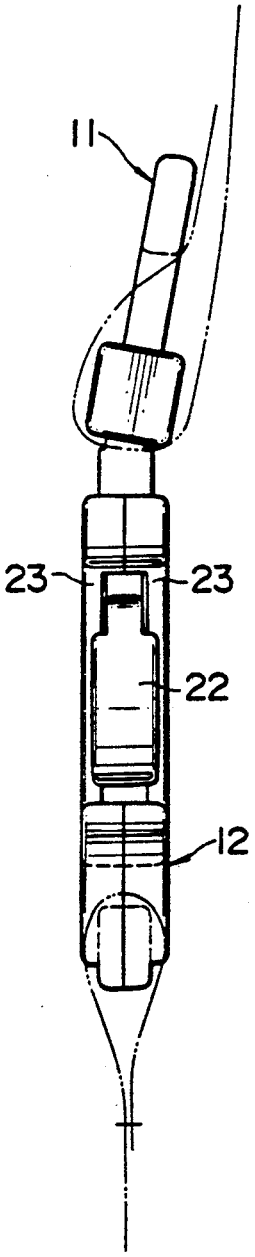
FIG. 2 is a side elevational view of the buckle of FIG. 1.
Figure 3:
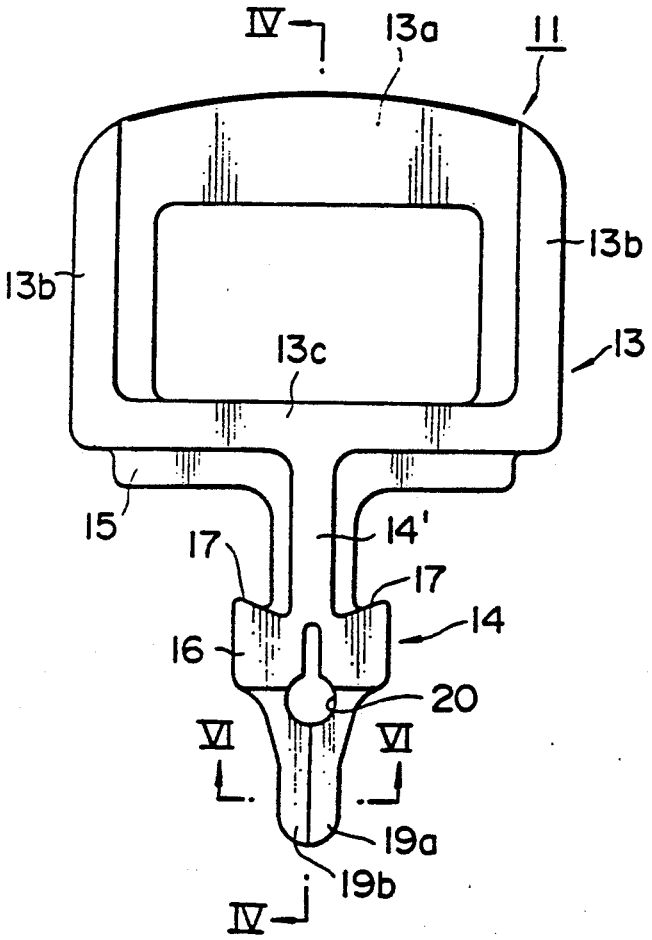
FIG. 3 is a front elevational view of the plug of the buckle.
Figure 4:
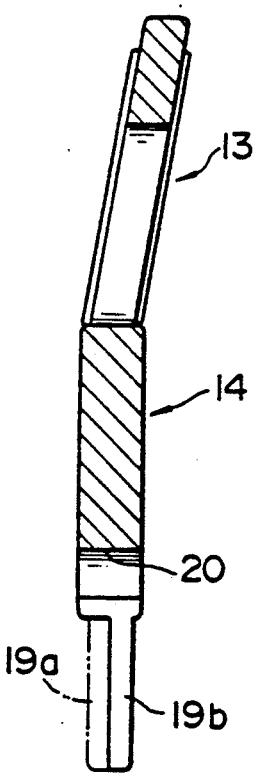
FIG. 4 is a cross-sectional view taken on line IV—IV of FIG. 3.
Figure 5:
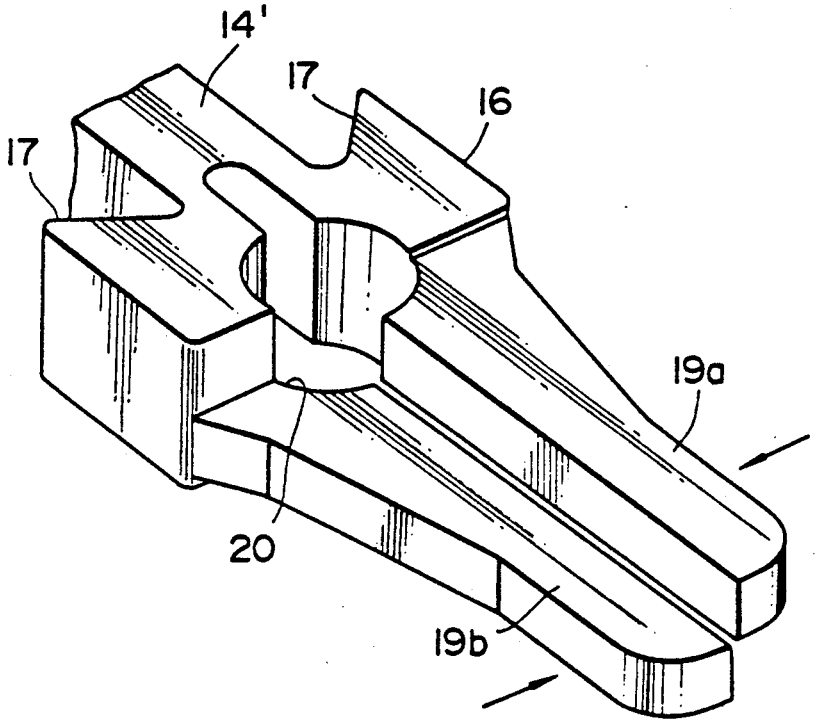
FIG. 5 is an enlarged fragmentary perspective view of a plug proper of the plug.
Figure 6A:
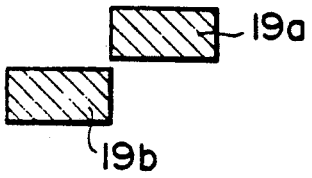
FIG. 6 (A) and 6 (B) are cross-sectional view taken on line VI—VI of FIG. 3, showing two different phases of resilient deformation of resilient legs of the plug proper.
Figure 6B:
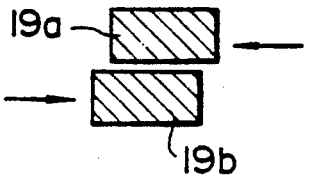

The principle of the present invention are particularly useful when embodied in a buckle as shown in FIGS. 1 and 2, generally indicated by reference numeral 10. The buckle 10 is made of synthetic resin and broadly comprises a plug 11 and a socket 12 releasably engageable with the plug 11. As better shown in FIGS. 3 through 6, the plug 11 comprises a belt attaching portion 13 in the shape of a rectangular frame including a rear rod 13*a*, a front rod 13*c* and a pair of side rods 13*b*, 13*b* joining at their respective opposed ends the opposed ends of rear rod 13*a* and the front rod 13*c*; and an arrow-shaped plug proper 14 extending forwardly from the middle of the front rod 13*c*. As better shown in FIG. 4, the belt attaching portion 13 is slightly inclined relative to the plug proper 14 and hence the socket 12, so as to cause the buckle 10 to fit the outline of a wearer's jaw when this buckle 10 is used with motorcycle helmets and so fourth. The plug proper 14 includes a shank 14' formed integrally on the front rod 13*c* and a plug head 16 formed contiguously to the front end of the shank 14'. As shown in FIG. 5, the plug head 16 is made wider than the shank 14' to thus define a pair of engaging shoulders 17, 17 one on each side of the shank 14' which shoulders 17, 17 project outwardly rearwardly of the plug head 16. The plug proper 14 further includes a pair of first and second resilient legs 19*a*, 19*b* provided on the front end of the plug head 16 and arranged in staggered relation to each other with regard to the central plane of the plug 11. This arrangement is such that compressing the first and second resilient legs 19*a* and 19*b* laterally in the plane of the plug 11 as indicated by two arrow marks in FIG. 5 causes the resilient legs 19*a*, 19*b* to cross with each other against their own resiliency in scissor-like fashion, as shown in FIG. 6 (B). The plug proper 14 has an aperture 20 formed on the boundary between the plug head 16 and the first and second resilient legs 19*a*, 19*b* for facilitating the resilient deformation of the resilient legs 19*a* and 19*b*. Although the aperture 20 shown here is combined circle and oblong, the shape of the aperture 20 is not limited to this. Any suitable shape will do, for example, oval or diamond. The combined thicknesses of the first and second legs 19*a*, 19*b* are slightly less than the thickness of the plug head 16. Reference numeral 15 denotes a pair of reinforcing ribs each extending continually on and along the front side of front rod 13*c* and one side of the shank 14' for reinforcing the front rod 13*c* and the shank 14'.

Figure 7:
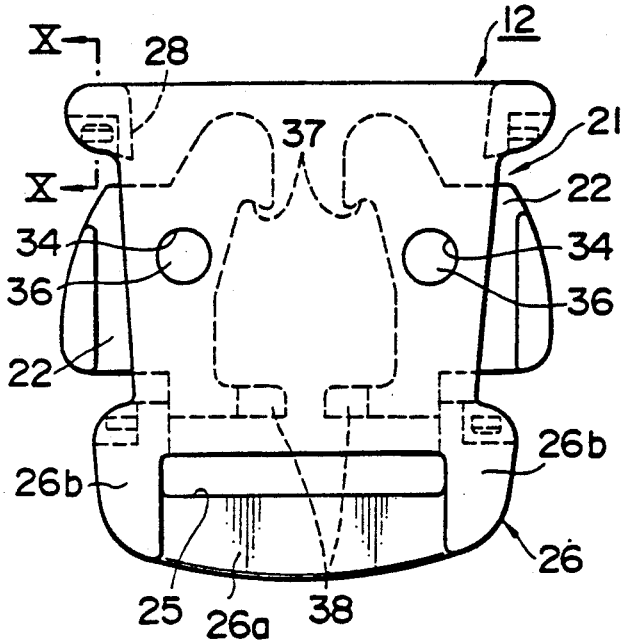
FIG. 7 is a front elevational view of a socket of the buckle.
Figure 8:
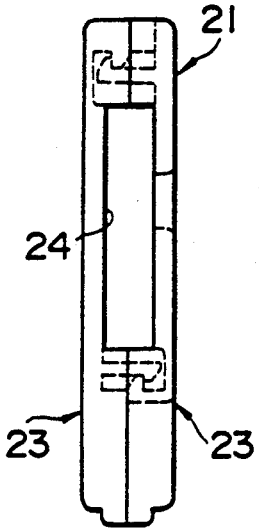
FIG. 8 is a side elevational view of the socket.
Figure 9:
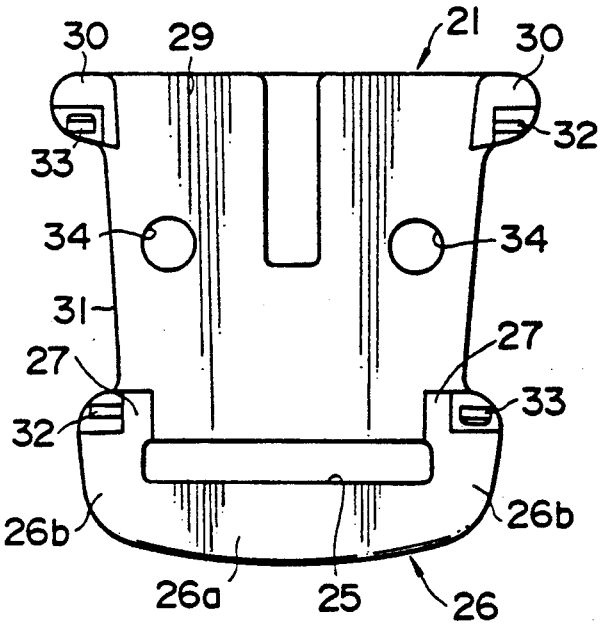
FIG. 9 is a front elevational view of a lower socket half.
Figure 10:
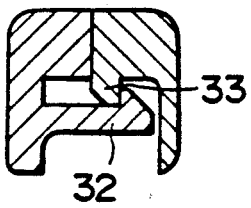
FIG. 10 is an enlarged cross-sectional view taken on line X—X of 7.

As better shown in FIGS. 7 and 8, the socket 19 generally comprises a substantially rectangular box-like socket body 21, a belt attaching portion 26 provided contiguously on the rear end of the socket body 21 and a pair of catch plates 22, 22 rotatably mounted within the socket body 21 for catching engagement with the plug 11, as closely described hereinafter. The socket body 21 comprises a pair of complementary socket halves 23, 23 of identical size and shape with each other, the companion socket halves 23, 23 being joined together in symmetrical relation to each other to thus define therebetween a chamber 50 for receiving the plug proper 14 therein and housing the pair of catch plates 22, 22 therein. Each rectangular socket half 21 includes a flat base plate 29 and thickened corner portions 30, 30, 27, 27 provided on the four corners thereof The belt attaching portion 26 comprises a pair of side rods 26*b*, 26*b* integrally extending rearwardly from the respective rear corners 27, 27 and a longitudinal rod 26*a* joining the respective rear ends of the side rods 26*b*, 26*b*, to thus define between those rods 26*a*, 26*b*, 26*b* and the rear end of the socket body 21 a rectangular aperture 25 for inserting one end of a belt therein. The socket body 21 has an opening 28 formed in its front end between the front corner portions 30, 30 so as to communicate with the chamber 50 and thus adapted for forcing the plug proper 14 therethrough into the chamber 50. The socket body 21 also has a pair of cutouts 24, 24, one on each side thereof, between the front and rear corner portions 30, 30; 27, 27 for permitting part of the catch plates 22, 22 to project out therethrough. A right front corner portion 30 and a left rear corner portion 27, as viewed in FIG. 9, disposed in diagonal relation to each other each has a engaging hook 32, while a left front corner portion 30 and a right rear corner portion 27 disposed in diagonal relation as well each has an engaging step 33 for coupling engagement with the engaging hook 32, as better shown in FIGS. 9 and 10. With such an arrangement, pressing two companion socket halves 23, 23 against each other in symmetrical relation causes the engaging hooks 32, 32 and engaging steps 33, 33 of one socket half 21 to come into snapping engagement with the engaging steps 33, 33 and the engaging hooks 32, 32, respectively, of the other companion socket half 21, thus coupling the two companion socket halves 23, 23 in only a single motion. The two companion socket halves 23, 23 are identical in size and shape with each other, which dispenses with the necessity of producing and storing two different shapes of socket halves. This advantageously reduces the manufacturing cost and storing expenses of the buckle as a whole. A pair of bearing holes 34, 34 are formed in each base plate 29 adjacent to the respective cutouts 24, 24, one pair of bearing holes 34, 34 of one socket half 23 being disposed in registry with the other pair of bearing holes 34, 34 of the companion socket half 23. The two pairs of bearing holes 34, 34; 34, 34 are thus adapted to rotatably support the concentric shafts 36, 36 of the pair of catch plates 22, 22 to be described hereinafter.

Figure 11:
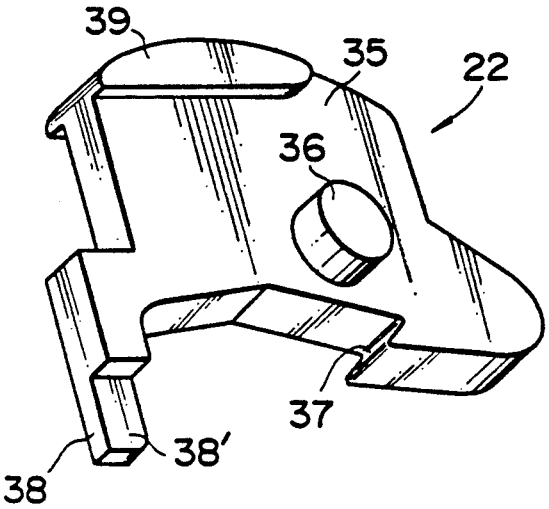
FIG. 11 is a perspective view of a catch plate.
Figure 12:
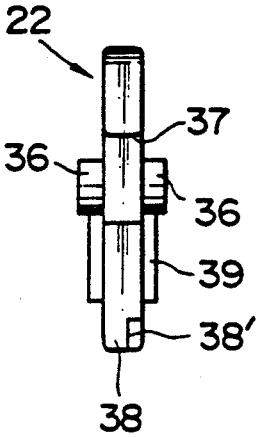
FIG. 12 is a side elevational view of the catch plate.
Figure 13:
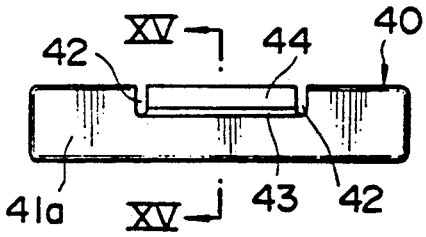
FIG. 13 is a front elevational view of a slide rod.

As shown in FIGS. 11 and 12, each of the catch plates 22, 22 comprises a base plate 35 being substantially rectangular, a pair of concentric shafts 36, 36 provided one on each surface and at the middle of the base plate 35, a hooked engaging prong 37 at its front lower corner and an abutting tail 38 provided on the rear lower corner. The concentric shafts 36, 36 are journaled in the bearing holes 34, 34 so that the catch plates 22, 22 are rotatably mounted on and within the socket body 21. The hooked engaging prong 37 of the catch plate 22 is adapted for, jointly with the counterpart 37 of the mating catch plate 22, coming into catching engagement with the engaging shoulders 17, 17 of the plug 11. Each abutting tail 38 extends inwardly from the rear corner for pressing either the first or second resilient legs 19*a*, 19*b* inwardly toward each other against their resiliency so as to cross the other leg 19*b*, 19*a* in scissor-like fashion. These abutting tails 38, 38 have steps 38', 38' on their respective confronting sides at their distal ends to permit the resilient legs 19*a*, 19*b* to cross each other. There is provided on the upper side (as viewed in FIG. 11) of the base plate 35 a thickened grip head 39 for facilitating manipulation of the catch plates 22, 22 by fingers.

For assembling the socket 12 whose construction has been closely explained hereinbefore, two catch plates 22, 22 are mounted on one of the mating socket halves 23, 23 with the shafts 36, 36 of the former fitting into the bearing holes 34, 34 of the latter. Subsequently, the other socket half 23 is covered on and in registry with the companion socket half 23 and pressed thereagainst at their four corner portions 30, 30, 27, 27, thus bringing the engaging hooks 32, 32 and the engaging steps 33, 33 of one socket half 23 into snapping engagement with the engaging steps 33, 33 and the engaging hooks 32, 32, respectively, of the other socket half 23 so that the socket 12 has been assembled at great ease as shown in FIG. 7.

Figure 15:
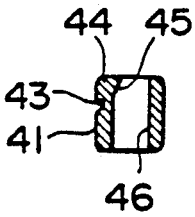
FIG. 15 is a cross-sectional view taken on line XV—XV of FIG. 13.
Figure 14:
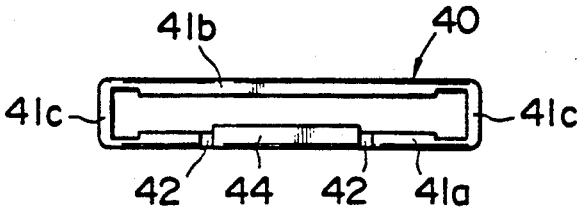
FIG. 14 is a plan view of the slide rod.

As shown in FIG. 1, the plug 10 further includes a slide rod 40 engageable with the the belt attaching portion 13 of the plug 10. The slide rod 40 is in the form of an elongated frame and comprises an upper and lower walls 41*a*, 41*b* and a pair of side walls 41*c*, 41*c* joining the opposed ends of the upper and lower walls 41*a*, 41*b* to thus define therebetween a tunnel 46 for slidably receiving the belt attaching portion 13 of the plug 11. As shown in FIG. 14, the upper wall 41*a* has a pair of short parallel slits 42, 42 cut normally in the rear edge thereof and a groove 43 formed between the rear ends of the slits 42, 42 to thus define therebetween a resilient flap 44. As shown in FIG. 15, the flap 44 has its lower side slant rearwardly downwardly to thus provide a bevelled stopper 45 on the rear edge of the flap 44.

In assembling the slide rod 40 on the belt attaching portion 13 of the plug 11, thrusting the rear rod 13*a* of the belt attaching portion 13 through the opening 46 of the slide rod 40 from the end free from the flap 44 causes the the belt attaching portion 13 to advance through the tunnel 46 while lifting the resilient flap 44 against its resiliency until its rear rod 13*a* leaves the resilient flap 44, whereupon the resilient flap 44 restores into the original posture under the resiliency so that the slide rod 40 has been slidably mounted on the belt attaching portion 13 of the plug 11. Once the slide rod 40 is mounted on the belt attaching portion 13, the bevelled stopper 45 of the thus restored flap 44 assuredly keeps the slide rod 40 from accidentally sliding off the rear rod 13*a* of the belt attaching portion 13.

With the construction of the buckle 10 according to the present invention described hereinabove, coupling and uncoupling operations of the buckle 10 are carried out as follows.

For coupling the plug 11 and the socket 12 together, the plug proper 14 is thrusted through the opening 28 and through between the catch plates 22, 22 into the chamber 50 of the socket 12, thus causing its resilient legs 19*a*, 19*b* to urge the abutting tails 38, 38 of the catch plates 22, 22 outwardly apart from each other. As a result, the catch plates 22, 22 are rotated on the shafts 36, 36 in the directions tending to cause their respective engaging prongs 37, 37 to move toward each other, thereby bringing the engaging prongs 37, 37 into catching engagement with the engaging shoulders 17, 17 of the plug proper 14. Consequently, the plug 11 has been coupled firmly with the socket 12 in a single motion.

Figure 16:
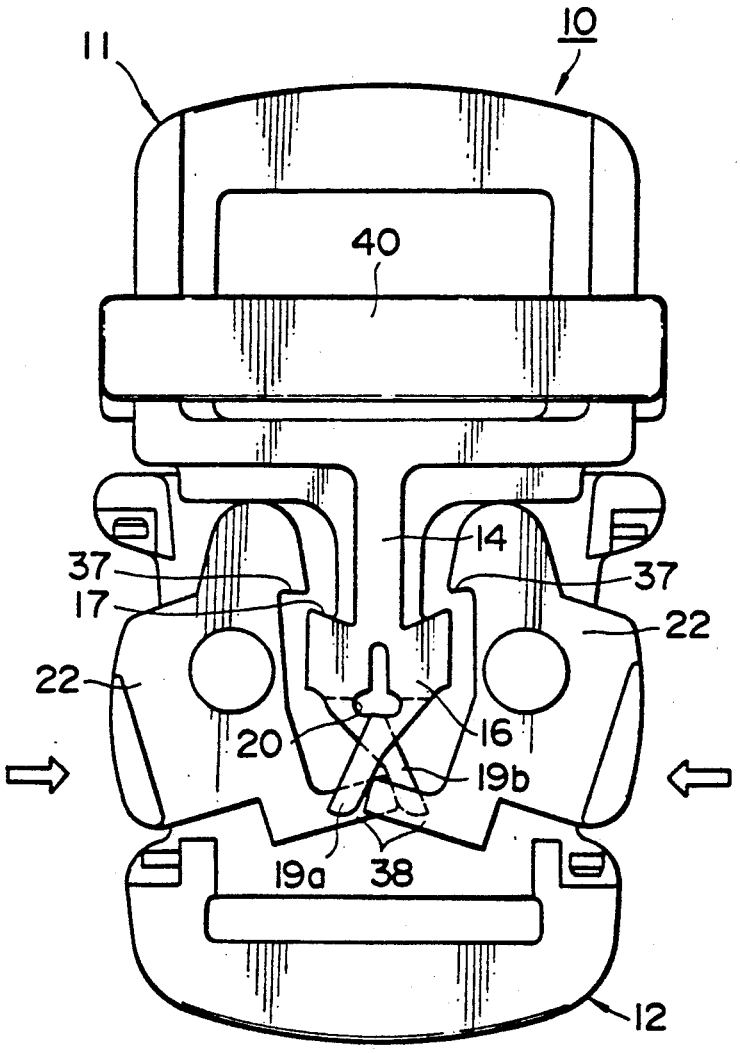
FIG. 16 is similar to FIG. 1 but showing the buckle with an upper socket half removed.

For uncoupling the plug 11 from the socket 12, grip heads 39, 39 are compressed by fingers as shown in FIG. 16. As a result, the catch plates 22, 22 are rotated on the shafts 36, 36 in such direction that the engaging prongs 37, 37 move away from each other. As the catch plates 22, 22 thus rotate on the shafts 36, 36, the abutting tails 38, 38 press the resilient legs 19*a* and 19*b*, against their own resiliecies, so that the resilient legs 19*a*, 19*b* yield to bend into crossing relation to each other. Continued rotation of the the catch plates 22, 22 causes the engaging prongs 37, 37 to come out of catching engagement with the engaging shoulders 17, 17 of the plug 11, at which instant the plug 11 snappingly springs out of the socket 12 under the resiliecy of the resilient legs 19*a*, 19*b*. The plug 11 has thus been uncoupled from the socket 12 in a single motion by one hand.

Since the plug 11 according to the present invention is so constructed as to incorporate the resilient legs 19*a*, 19*b* for the purpose of urging the catch plates 22, 22 in the directions to cause their respective prongs 37, 37 to engage with the plug 11, a separate spring for this purpose has been dispensed with. The number of parts has been reduced to minimum, so that the buckle as a whole has been less expensive and the assemblage thereof has been simplified.

Obviously, various modifications and variations of the present invention are possible in the light of the above teaching. It is therefore to be understood that within the scope of the appended claims the invention may be practiced otherwise than as specifically described.

What is claimed is:

1. A buckle comprising:

a plug; and a socket releasably engageable with the plug, the socket including a socket body being of a box-like construction and having an opening formed in its front end, and a pair of catch plates pivotally mounted at their respective middles on the opposite sides of the socket body and each having at its front end an engaging prong and at its rear end an abutment;

the plug including a plug proper having a shank, a plug head formed contiguously to a front end of the shank and having on its opposed sides a pair of engaging shoulders, and means provided on a front end of the plug head, the means being resilient per se, for resiliently urging the abutments outwardly apart from each other, when the plug proper is inserted into the socket body.

2. A buckle according to claim 1, the urging means comprising first and second resilient legs provided on the front end of the plug head and arranged in staggered relation to each other with regard to the central plane of the plug, the first and second resilient legs coming into urging engagement with the respective abutments when the plug proper is inserted into the socket body.

3. A buckle according to claim 2, the plug proper having an aperture formed on the boundary between the plug head and the first and second resilient legs.

4. A buckle according to claim 1, a socket body being of a substantially rectangular box-like construction and comprising a pair of complementary socket halves, each socket half including a flat base plate and thickened corner portions provided on the four corners thereof, a pair of corner portions disposed in diagonal relation to each other each having an engaging hook, while the other pair of corner portions disposed in diagonal relation each having an engaging step for coupling engagement with the mating engaging hooks of the companion socket half.

5. A buckle according to claim 1, the plug further including a belt attaching portion extending rearwardly from the rear end of the plug proper, the belt attaching portion being slightly inclined relative to the plug proper.

6. A buckle according to claim 5, the belt attaching portion being in the shape of a rectangular frame and including a rear rod, a front rod from the middle of which the shank extends forwardly, and a pair of side rods joining at their respective opposed ends the opposed ends of the rear rods and the front rod.

7. A buckle according to claim 1, wherein said means for resiliently urging comprises at least one member, said member abutting said abutments for urging the abutments apart from each other, said member itself flexing to provide said resilient urging.

8. A buckle according to claim 7, wherein said at least one member comprises two members mounted to said plug head in cantilever fashion, each of said members having an outside facing surface abutting one abutment, said outside facing surfaces inclined to a direction of insertion of said plug proper into said socket, said members arranged to be flexible toward each other in cantilever fashion to provide said resilient urging.

9. A buckle according to claim 8, wherein said members are arranged in staggered fashion, and said members are sufficiently flexible toward each other to overlap each other during flexing.

10. A buckle according to claim 9, wherein said catch plates further comprise a grip head positioned on each of said catch plates, said grip heads extending exterior of said socket on opposite sides of said socket body, said grip heads arranged on said catch plates on a side of said middles toward said rear end of said catch plates, arranged for a user to squeeze said grip heads toward each other, to forcibly pivot said catch plates and move said abutments toward each other against the resilient urging of said members, said members flexible enough to allow said engaging prongs to pivot away from each other a sufficient distance to pass said engaging shoulders therebetween.

11. A buckle comprising:

a plug; and a socket releasably engageable with the plug, the socket including a socket body being of a box-like construction and having an opening formed in its front end, and a pair of catch plates pivotally mounted at their respective middles on the opposite sides of the socket body and each having at its front end an engaging prong and at its rear end an abutment;

the plug including a plug proper having a shank, a plug head formed contiguously to the front end of the shank and having on its opposed sides a pair of engaging shoulders and means provided on the front end of the plug head for, when the plug proper is inserted into the socket body, urging the abutments outwardly apart from each other, the plug including a belt attaching portion extending rearwardly from the rear end of the plug proper, the belt attaching portion being slightly inclined relative to the plug proper the belt attaching portion being in the shape of a rectangular frame and including a rear rod, a front rod from the middle of which the shank extends forwardly, and a pair of side rods joining at their respective opposed ends the plug including a pair of reinforcing ribs each extending continually on and along a front side of the front rod and one side of the shank.

12. A buckle comprising:

a plug; and a socket releasably engageable with the plug, the socket including a socket body being of a box-like construction and having an opening formed in its front end, and a pair of catch plates pivotally mounted at their respective middles on the opposite sides of the socket body and each having at its front end an engaging prong and at its rear end an abutment;

the plug including a plug proper having a shank, a plug head formed contiguously to the front end of the shank and having on its opposed sides a pair of engaging shoulders and means provided on the front end of the plug head for, when the plug proper is inserted into the socket body, urging the abutments outwardly apart from each other, the plug including a belt attaching portion extending rearwardly from the rear end of the plug proper, the belt attaching portion being slightly inclined relative to the plug proper, the plug including a slide rod being in the shape of an elongated frame and comprising an upper and lower walls and a pair of side walls joining the opposed ends of the upper and lower walls to thus define therebetween a tunnel for slidably receiving the belt attaching portion, the upper wall having a pair of spaced parallel short slits cut in the rear edge thereof to thus define therebetween a resilient flap.

13. A buckle according to claim 12, the resilient flap further having a groove formed between the rear ends of the slits.

14. A buckle according to claim 12, the resilient flap having its lower surface slant rearwardly downwardly to thus provide a bevelled stopper on the rear edge of the flap.

* * * * *